United States Patent [19]

Miller

[11] 4,027,782

[45] June 7, 1977

[54] METHOD AND APPARATUS FOR DISCHARGE OF HOT ASPHALT TANKER

[76] Inventor: Adason Morey Miller, 400 Blackstone, LaGrange, Ill. 60525

[22] Filed: Mar. 25, 1976

[21] Appl. No.: 670,185

[52] U.S. Cl. ..... 222/1; 222/609; 222/481.5

[51] Int. Cl.² ..... B67D 3/00

[58] Field of Search ..... 222/478, 479, 481.5, 222/482, 178, 133, 383, 385, 1

[56] References Cited

UNITED STATES PATENTS

| | | | |
|---|---|---|---|
| 2,199,657 | 5/1940 | Bunch | 222/385 X |
| 3,907,162 | 9/1975 | Maxfield | 222/178 X |

*Primary Examiner*—Stanley H. Tollberg
*Assistant Examiner*—Hadd Lane
*Attorney, Agent, or Firm*—Kinzer, Plyer, Dorn & McEachran

[57] ABSTRACT

A method and sequence of operating a pump and vent on a hot asphalt transport tank to avoid release of noxious fumes to the atmosphere during discharge of asphalt from the tank, and a quick-acting vent characterized by a toggle release, for carrying out that method.

7 Claims, 4 Drawing Figures fig.1.
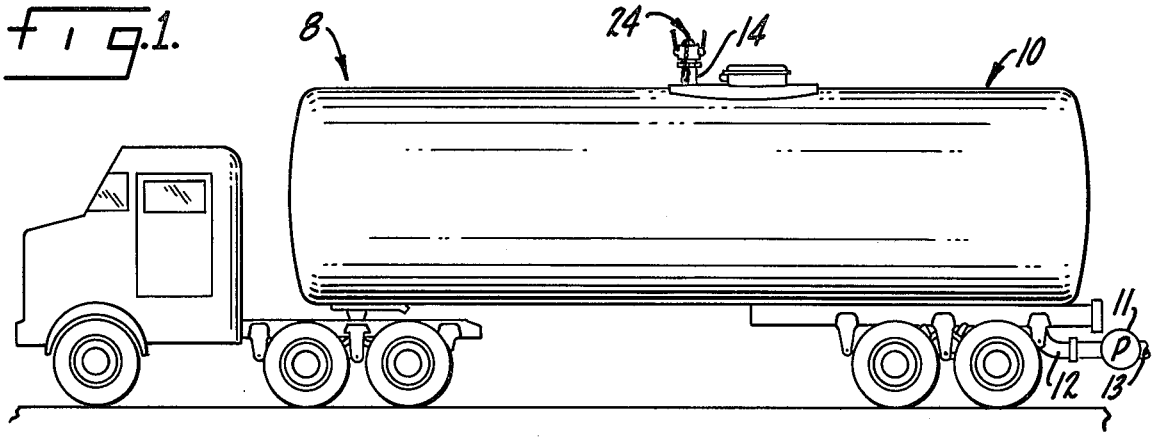
fig.3.
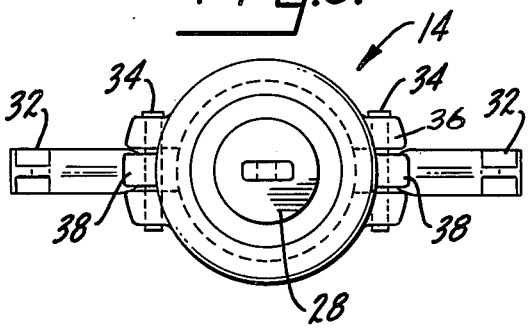
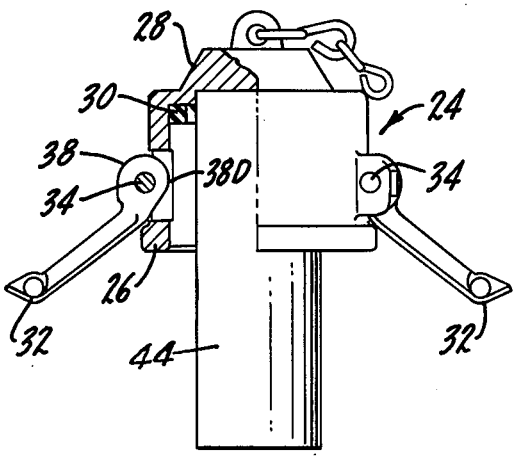
fig.2.
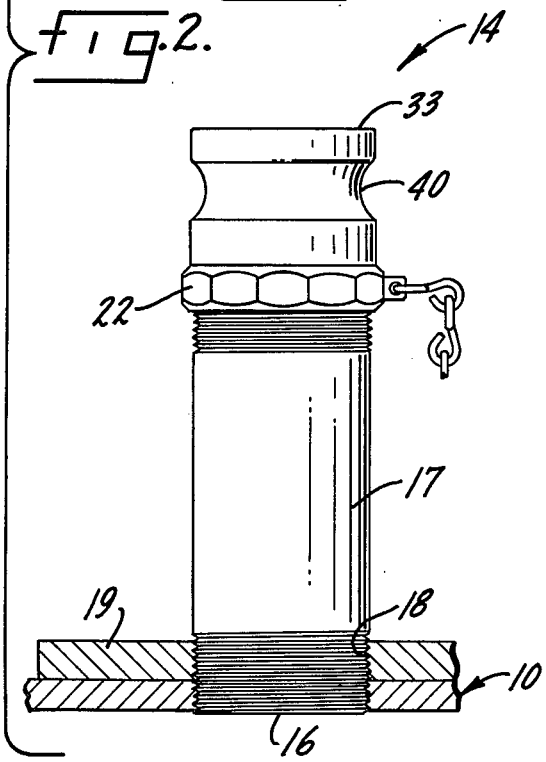
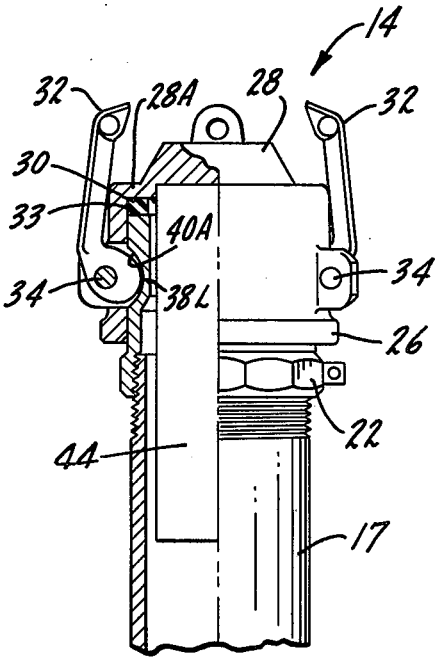
fig.4.

METHOD AND APPARATUS FOR DISCHARGE OF HOT ASPHALT TANKER

This invention relates to a method and apparatus for diminishing or eliminating the mission of noxious fumes during unloading of hot asphalt from a heated tank trailer or car.

Laws concerned with environmental protection prohibit the release of noxious fumes ordinarily present in the heated tank trailers used to transport hot asphalt used for road building and other applications. When the asphalt is actually pumped from the tanker into local storage facilities it is customary to open the large "manhole" opening of the tank to vent the interior of the tank to the atmosphere, resulting in the emission of noxious fumes now deemed environmentally unacceptable. The frequent result is a citation for violation of environmental protection regulations.

The object of the present invention is to eliminate the adverse environmental impact of unloading a tank of hot asphalt to storage while nonetheless enabling the tank to be vented as necessary. Specifically, it is an object of the present invention to maintain the tank of hot asphalt sealed from the atmosphere until the discharge pump is started, whereupon a small vent is opened, with scarcely a pause in between, so that pump action is not adversely affected and the tank is not collapsed. Yet another object of the invention is to enable this sequence of operation to be efficiently practiced by means of a quick-release closure cap for the vent opening.

In the drawing:

FIG. 1 is an elevation view of a semi-trailer, asphalt tanker rig;

FIG. 2 is an exploded view, on an enlarged scale compared to FIG. 1, showing the manner in which the tank may be vented through a sleeve in accordance with the present invention;

FIG. 3 is a top plan view of the closure cap;

FIG. 4 is a view partly in section and partly in elevation showing features of the toggle incorporated in the closure cap.

FIG. 1 shows a heated tanker unit 8 for use in the transport of hot asphalt. Tanker 8 may be a semi-trailer hauled by a tractor, as shown, or may constitute a trailer towed by a truck or otherwise. The hot asphalt, in the context of the present invention, is discharged from the tank 10 by a pump 11 through an outlet pipe 12 on tank 10. Pump 11 is typically a high volume, high-velocity pump (e.g., 300 gallons/minute), and may be mounted on tanker 8 or may be separate from the tanker. A high-velocity pump is most desirable to preclude undue cooling of the asphalt passing through conduits 12 and 13 and pump 11.

In order that pump 11 may be effective without engendering possible collapse of tank 10, it is necessary to vent the interior of tank 10 to the ambient atmosphere while pumping asphalt from the tank. Collapse of tank 10, if not adequately vented, is a very real possibility because of the high discharge rates customarily employed. This is accomplished by a vent 14 at the top of tank 10 that is substantially smaller than and independent of the usual "manhole" 15.

Referring to FIG. 2, the vent 14 comprises a short pipe or sleeve 17 of moderate size, usually about 2 inches I.D., having a lower or inner end 16 threaded into a tapped opening 18 in the reinforced top wall 19 of the tank or vessel 10. A collar 22 is threaded or otherwise mounted on the upper or outer end of sleeve 17; as explained in more detail, collar 22 serves as a reaction surface for a toggle joint incorporated in a closure cap 24 which is used to seal the outer end of the sleeve 17. In effect, collar 22 is an extension of the pipe 17.

Closure cap 24 has a continuous circular skirt 26 and a closed top wall 28. A thick elastomeric seal ring 30 is securely seated in the top corner of the recess 31 formed by top wall 28 and skirt 26 of the closure cap so as to fit complementally the circular edge at the free end of the collar 22 and thus seal vent 14. When seal ring 30 is tightly engaged with the outer rim 33 of sleeve 14, the interior of tank 10 is sealed from the atmosphere and none of the noxious fumes generated by heated asphalt in the tank can escape either during hauling of the trailer or at the time it is being maneuvered at the delivery area.

To tightly seal cap 24 onto vent collar 22, a toggle mechanism is included as a part of the cap. Accordingly, all that is required to vent tank 10 is to release the toggle, which can be quickly accomplished, allowing the interior of the tanker vessel to be vented to the atmosphere. Thus, a pair of toggle links or arms 32 are pivotally mounted on toggle joint pins 34 on cap 24; pins 34 are supported by a pair of lugs 36 located on opposite sides of the cap skirt. Toggle arms 32 have eccentrics or cams 38 located opposite a groove 40 which extends continuously about the exterior portion of collar 22 as best shown in FIG. 2.

The other link for each toggle is the cap itself. Thus, when cap 24 is set on the outer rim 33 of the collar 22 on sleeve 17, with toggle arm 32 at their depressed positions (FIG. 2), the low part or dwell 38D of each toggle eccentric 38 is presented to groove 40. With both toggle arms in this position cap 24 may be easily displaced, from sleeve 17, FIG. 2, characterizing the released state of vent 14 with the interior of tank 10 vented through the small pipe 17.

On the other hand, by moving each toggle arm upwardly to the position shown in FIG. 4, the high part or lobe 38L of each eccentric is presented in camming relation to the upper shoulder 40A of the groove 40. The action and reaction involved in effect pulls the cap downwardly, compressing seal ring 30 on the rim 33 of collar 22; cam surface 38L acts a prise as it is cammed against wall 40A, imparting a downward thrust against the toggle pin 34, which in turn tightens the top wall of the cap on the seal 30.

From this it will be seen that the end or top wall portion 28A of the cap, FIG. 4, which opposes the free end 33 of collar 22, is also part of a toggle link of which arm 32 is the other link. In any event, the cap is quickly locked to complete the seal by forcing the toggle links 32 upward.

When the hot asphalt is to be pumped from tank 10 to storage, pump 11 is first started. Contrary to conventional practice, the large manhole 15 of tank 10 is not opened, so that the noxious fumes accumulated inside the tank are not released to the atmosphere. The limited pressure drop in tank 10 caused by initial operation of pump 11 causes air to flow into tank 10 without allowing escape of fumes already present in the tank, a mode of operation made possible by the small side of vent sleeve 17.

Promptly after pump 11 is started, a workman atop the tank forces toggle arms 32 downward and quickly removes cap 24 (anchored to the chain 42) to expose the small vent opening afforded by vent 14. This may be quickly accomplished simply by kicking the toggle links downwardly. The mild "vacuum" prevailing inside the tank, due to preliminary brief operation of pump 11, prevents the fumes from escaping to the atmosphere in any appreciable amount.

For tanks of moderate size, one person can start the pump and can then promptly release the toggle cap 24, removing the cap and setting it to one side of sleeve 17. The point is that the toggle enables vent 14 to be opened almost instantaneously after starting pump 11. This is essential to safe operation because protracted operation of pump 11 without venting of tank 10 is likely to collapse the tank. The described toggle connection construction for collar 22 and the mating vent cap 24 is one long proven in use in quick-close, quick-release hose couplings. It is essentially similar to the hose coupling mechanism shown in U.S. Pat. No. 2,518,026.

Other forms of quick-release connection can be used for mounting cap 24 on vent pipe 17; the mechanism employed should be simple, rugged, and reliable to avoid any possibility of tank collapse due to failure of the vent cap release. One advantage of the illustrated quick-close, quick-release mechanism is that it can be released, without removing cap 24. Thus, the workman discharging tank 10 can release the toggle mechanism, then start pump 11, and can then be certain that cap 24 is readily and promptly removable to vent tank 10, all without release of fumes from the tank to the atmosphere.

In order to keep the interior of vent 14 reasonably clean (hot asphalt splashed up into sleeve 17 during transport may cool enough to solidify in the sleeve) a long filler plug 44 is welded to or otherwise mounted on the inner top wall of the cap. Plug 44 is of such length as to extend well into sleeve 17, with only a slight circumferential clearance so as to substantially fill the inside of the sleeve.

I claim:

1. The method of discharging hot asphalt from a heated tanker of the kind comprising a large sealed manhole opening connected to the tank, a discharge conduit connected to the bottom of the tank, and having a small normally closed vent connected to the top of the tank, comprising:

initiating high-velocity pumping of hot asphalt from the tank, through the discharge conduit;

and subsequently promptly opening the small vent to allow entry of air into the tank, without release of noxious fumes to the atmosphere, to preclude a pressure reduction in the tank sufficient to collapse the tank, while maintaining the manhole opening sealed throughout the discharge operation.

2. The method of discharging hot asphalt from a tanker, according to claim 1, using a quick-close, quick-release cap to close the vent, in which the cap is released before pumping is initiated but removed after pumping is initiated.

3. In a tanker for transporting hot asphalt, comprising a heated storage tank, a large sealed manhole opening connected to the tank, and a discharge conduit connected to the bottom of the tank, a vent permitting discharge of the contents of the tank without release of noxious fumes to the atmosphere comprising:

a vent sleeve, much smaller than the manhole, mounted on and connected to the top of the tank;

a closure cap mountable on the outer end of the vent sleeve for sealing the vent sleeve;

and a quick-close, quick-release mechanism interconnecting the closure cap and the vent sleeve, permitting rapid mounting and de-mounting of the closure cap on the sleeve.

4. A tanker for hot asphalt transport, according to claim 3, in which the mechanism interconnecting the closure cap and the vent sleeve comprises at least one toggle link mounted on the cap and acting against the sleeve to secure the cap in sealing position on the sleeve.

5. A tanker for hot asphalt transport, according to claim 4, in which the toggle link comprises a toggle arm pivoting on a toggle joint pin supported by the cap, the toggle arm having an eccentric engageable in a groove in the sleeve to apply a downward thrust to the pin which thrust in turn is applied to the cap to compress the seal.

6. A tanker for hot asphalt transport, according to claim 3, in which an internal filler plug is mounted on the cap in position to extend downwardly into the sleeve, substantially filling the interior of the sleeve when the cap is mounted on the sleeve and preventing clogging of the sleeve with asphalt.

7. A tanker for hot asphalt transport, according to claim 3, in which the vent sleeve has an internal diameter of the order of 2 inches.

* * * * *